US011350512B2

(12) United States Patent
Takman et al.

(10) Patent No.: US 11,350,512 B2
(45) Date of Patent: May 31, 2022

(54) METHOD FOR CONTROLLING AN X-RAY SOURCE

(71) Applicant: Excillum AB, Kista (SE)

(72) Inventors: Per Takman, Kista (SE); Ulf Lundström, Kista (SE)

(73) Assignee: EXCILLUM AB, Kista (SE)

( * ) Notice: Subject to any disclaimer, the term of this patent is extended or adjusted under 35 U.S.C. 154(b) by 0 days.

(21) Appl. No.: 17/057,192

(22) PCT Filed: Jun. 7, 2019

(86) PCT No.: PCT/EP2019/064938
§ 371 (c)(1),
(2) Date: Nov. 20, 2020

(87) PCT Pub. No.: WO2019/234217
PCT Pub. Date: Dec. 12, 2019

(65) Prior Publication Data

US 2021/0195724 A1 Jun. 24, 2021

(30) Foreign Application Priority Data

Jun. 8, 2018 (EP) ..... 18176702

(51) Int. Cl.
*H05G 1/52* (2006.01)
*H01J 35/14* (2006.01)
*H05G 1/26* (2006.01)

(52) U.S. Cl.
CPC ..... *H05G 1/52* (2013.01); *H01J 35/153* (2019.05); *H05G 1/265* (2013.01)

(58) Field of Classification Search
CPC .... G21K 1/06; G21K 1/067; G21K 2207/005; G21K 1/02; G21K 1/08; G21K 5/00;
(Continued)

(56) References Cited

U.S. PATENT DOCUMENTS

2002/0015473 A1* 2/2002 Hertz ..... H01J 35/08 378/119
2002/0044629 A1* 4/2002 Hertz ..... H05G 2/003 378/119

(Continued)

FOREIGN PATENT DOCUMENTS

EP 3312868 A1 4/2018
WO 2012087238 A1 6/2012

OTHER PUBLICATIONS

Hemberg et al., "Liquid-metal-jet anode x-ray tube", Optical Engineering, Jul. 1, 2004, pp. 1682-1688.

(Continued)

*Primary Examiner* — Irakli Kiknadze
(74) *Attorney, Agent, or Firm* — Buchanan Ingersoll & Rooney P.C.

(57) ABSTRACT

A method for controlling an X-ray source configured to emit, from an X-ray spot on a target, X-ray radiation generated by an interaction between an electron beam and the target, wherein the X-ray spot is determined by the field of view of an X-ray optical system of the X-ray source. The method includes providing the target, providing the electron beam forming an electron spot on the target and interacting with the target to generate X-ray radiation, and adjusting a width and total power of the electron beam such that a maximum of the power density profile in the electron spot is below a predetermined limit, and such that a total power delivered to the target in the X-ray spot is increased.

11 Claims, 6 Drawing Sheets

(58) Field of Classification Search
CPC .... G21K 5/04; G21K 1/062; G21K 2201/064; G21K 2201/067; H01J 2235/082; H01J 2235/086; H01J 35/112; H01J 35/147; H01J 35/153; H01J 35/30; H01J 35/08; H01J 35/14; H01J 2235/168; H01J 35/02; H01J 2235/081; H01J 2235/088; H01J 2235/205; H01J 35/025; H01J 35/18; H01J 35/20; H01J 35/00; H01J 2235/1204; H01J 2235/1225; H01J 2235/1279; H01J 35/116; H05G 1/58; H05G 1/265; H05G 1/46; H05G 1/52; H05G 2/008; H05G 2/003; H05G 2/005; H05G 2/006; H05G 1/02; H05G 1/30; H05G 2/001; H05G 1/26; H05G 1/04; H05G 1/36; H05G 1/08; H05G 1/54; H05G 2/00; G01N 23/223; G01N 2223/076; G01N 2223/501; G01N 23/201; G01N 23/207; G01N 2033/0095; G01N 2223/1016; G01N 23/083; G01N 23/20; A61B 6/484; A61B 6/4007; A61B 6/4291; A61B 6/508; A61B 6/4233; A61B 17/3203; A61B 18/26; A61B 2017/32032; A61B 2018/263; A61B 6/022; A61B 6/03; A61B 6/032
USPC ..... 378/113, 119, 137, 138, 143
See application file for complete search history.

(56) References Cited

U.S. PATENT DOCUMENTS

| | | | | |
|---|---|---|---|---|
| 2015/0110249 | A1* | 4/2015 | Bakeman | G01N 23/201 378/87 |
| 2015/0179388 | A1* | 6/2015 | Hemberg | H01J 29/62 250/503.1 |
| 2015/0380202 | A1 | 12/2015 | Ollinger et al. | |
| 2018/0206318 | A1* | 7/2018 | DeCiccio | H05G 2/005 |
| 2019/0011579 | A1* | 1/2019 | Kucharczyk | G01N 23/20008 |
| 2019/0131103 | A1* | 5/2019 | Tuohimaa | H01J 35/20 |
| 2020/0058461 | A1* | 2/2020 | Takman | H01J 35/116 |
| 2021/0027974 | A1* | 1/2021 | Hansson | H01J 35/153 |

OTHER PUBLICATIONS

International Search Report (PCT/ISA/210) dated Aug. 23, 2019, by the European Patent Office as the International Searching Authority for International Application No. PCT/EP2019/064938.

Written Opinion (PCT/ISA/237) dated Aug. 23, 2019, by the European Patent Office as the International Searching Authority for International Application No. PCT/EP2019/064938.

International Preliminary Report on Patentability dated May 18, 2020, by the European Patent Office for International Application No. PCT/EP2019/064938.

* cited by examiner

METHOD FOR CONTROLLING AN X-RAY SOURCE

TECHNICAL FIELD

The inventive concept described herein generally relates to electron impact X-ray sources, and in particular to methods for controlling such X-ray sources.

BACKGROUND

X-ray sources of high power and brilliance are applied in many fields, for instance medical diagnostics, nondestructive testing, crystal structural analysis, surface physics, lithography, X-ray fluorescence, and microscopy. In some applications, the resolution of an obtained X-ray image basically depends on the distance to the X-ray source and the size of the source; the number of useful X-rays generated in the anode of the X-ray source is proportional to the electron beam current striking the anode. The challenge has always been to extract as much X-ray power as possible from as small a source as possible, i.e. to achieve high brilliance. The energy that is not converted into X-ray radiation is primarily deposited as heat in the target. The primary factor limiting the power, and the brilliance, of the X-ray radiation emitted from a conventional X-ray tube is the heating of the anode. More specifically, the electron-beam power must be limited to the extent that the anode material does not melt, in case the anode is a solid target, or evaporate, in case the anode is a liquid target.

There is a need for improved X-ray sources.

SUMMARY OF THE INVENTION

It is an object of the present inventive concept to provide an improved method for controlling an X-ray source.

According to a first aspect of the inventive concept, a method for controlling an X-ray source is provided, the X-ray source being configured to emit, from an X-ray spot on a target, X-ray radiation generated by an interaction between an electron beam and the target. The X-ray spot may be determined by the field of view of an X-ray optic system of the X-ray source. The method comprises the steps of: providing a liquid jet forming the target; providing the electron beam, which is arranged to form an electron spot on the target and to interact with the target to generate X-ray radiation; and determining a power density profile of the electron beam. The method further comprises adjusting a width and a total power of the electron beam such that a maximum of the power density profile in the electron spot is below a predetermined limit, and such that a total power delivered to the target in the X-ray spot is increased.

In general, the inventive concept involves the realization that the amount X-ray radiation is primarily determined by the total power delivered to the X-ray spot on the target, whereas the risk of overheating or other thermally induced issues for some types of targets may be determined by the maximum of the power density absorbed by the target in the electron spot. This situation is for example valid for the case when the thermal energy deposited in the target is transported away in an efficient manner. For a liquid jet, new material is supplied in a continuous fashion, and thus it is the maximum power density, rather than the total absorbed energy, that is the main limiting parameter. Thus, for a liquid jet it may not matter, from a thermal load point of view, where on the target electrons are absorbed, as long as the maximum of the power density profile on the target is below a threshold value. Further, it is realized that for many target and X-ray optics configurations, there may be no exact coincidence between the X-ray spot and the electron spot. Thus, by adjusting the width and total power of the electron beam such that the total power delivered to the target in the X-ray spot is increased, and at the same time limiting the maximum of the power density delivered to the target over the entire electron spot, the production of X-ray radiation may be increased without subjecting the target to thermal overload.

The X-ray spot, or region of interest for the generation of X-rays, may refer to a surface or volume on the target wherefrom X-ray radiation is emitted and received by an X-ray optic system. The X-ray spot may thus be defined and/or limited by X-ray optics of the X-ray source, i.e. the X-ray optics may be configured to transmit X-ray radiation from the X-ray spot on the target. The X-ray spot may, in other words, be considered to be limited by the field of view of the X-ray optics. The X-ray spot may in addition, or alternatively, be defined and/or limited by a geometry of the target and/or the orientation of the target relative the X-ray optic system. An embodiment with a cylindrical target where the X-ray radiation is emitted perpendicularly to the electron beam direction may for example have an X-ray spot defined by the target shape, the finite penetration depth of X-rays within the target material, and the angular relation between the emitted radiation and the X-ray optics.

The electron spot may refer to a surface on the target onto which the electron beam impinges the target. The width of the electron spot may be defined as the full width at half maximum of the electron beam power density profile on the target. The projection of the electron beam on the target may thus be referred to as a 'spot size' or 'electron spot' of the electron beam. The electron beam may have a Gaussian power density distribution. It should be noted that the electron spot may be different from the X-ray spot, depending on the field of view of the X-ray optics. The X-ray spot may for example form a subset of the electron spot.

The electron beam may be considered to deliver a certain power to the target. The power, known to be defined as total amount of energy delivered to the target per unit time, may be determined by the energy, and total number (or flux), of electrons delivered per unit time. The delivered power per unit area (or unit length) of the target may be referred to as power density, and may be considered to represent an average power per unit area of electron spot region of the target. In the context of the present disclosure, the terms "power density profile" and "power density distribution" may be used interchangeably to denote the local distribution of the power density within a certain region of the target. These terms are introduced to capture the fact that the power density may vary over a cross section of the electron beam, such that different portions of the electron spot on the target may be exposed to different thermal loads.

As already mentioned, the power density may refer to the applied power per unit area, or to the applied power per unit length of the electron spot. For a liquid jet in particular, the limiting factor, from a thermal load point of view, may be the applied power per unit length, as measured perpendicular to the jet travel direction, rather than per unit area. This due to the constant replenishment of target material in the jet travel direction, which makes the accumulated thermal load less interesting than the maximum, or peak, thermal load in the electron spot. In other words, for a liquid jet the height of the electron beam may be neglected when considering the allowed thermal load. Adjusting the width or cross sectional area of the electron beam may therefore affect the power density profile. Further, it may be preferable to adjust the total power of the electron beam such that the maximum of the power density profile delivered to the target is at a desired level to avoid or at least reduce the risk of overheating.

The method according to the present inventive concept may be performed many times over a lifetime of an X-ray source in order to assure that a desired performance is maintained. In particular, the method may be performed regularly to compensate for aging effects of the electron source. It has been shown that some types of electron sources tend to produce a power density pattern that varies over time, and the present inventive concept therefore provides a technology for compensating for these effects and for maintaining a good performance of the X-ray source as the X-ray source and/or its components are aging.

The term 'displaced' may, in the context of the present disclosure, be interpreted as a deflection of e.g. an electron beam.

The term 'setting' in the context of the present disclosure may comprise 'adjusting', e.g. a step of setting a power density may comprise a step of adjusting the power density. In other words, the power density (and/or any other setting of the X-ray source such as electron beam width, electron beam power etc.) may be set already when the X-ray source is powered on, and conversely an adjustment of the same may be needed when the X-ray source is powered on.

According to an embodiment, the width and total power of the electron beam may be adjusted such that an X-ray source performance indicator is below a predetermined threshold. The X-ray source performance indicator may be associated with at least one of: a total vapor generation from the target; a maximum power density delivered to the target by the electron beam; a maximum surface temperature of the target; and a maximum in delivered power per unit length, by the electron beam, along a width of the target.

The total vapor generation from the target, the maximum power density delivered to the target by the electron beam, the maximum surface temperature of the target and the maximum in delivered power per unit length, by the electron beam, along a width of the target, may be interrelated in the sense that by determining one of the above performance indicators information pertaining to any of the other performance indicators may be deduced.

The total vapor generation from the target may be a result of the electron beam interacting with the target, e.g. the electron beam delivering energy to the target causing the target to heat up, which may cause the material of the target to vaporize. The total vapor generation may be monitored and determined by a vapor sensor arranged in the X-ray source.

The maximum power density delivered to the target by the electron beam may represent e.g. a vapor generation from the target, and/or a maximum surface temperature of the target. By keeping the maximum power density delivered to the target by the electron beam below a predetermined threshold, it may be possible to limit e.g. vapor generation from the target, and/or limit a maximum surface temperature of the target. The maximum power density delivered to the target may be determined by determining a power density profile of the electron beam.

The maximum surface temperature of the target may be determined by a temperature sensor arranged in the X-ray source. The maximum surface temperature may alternatively, or in addition, be determined by determining the power density profile and by determining material properties of the target.

The maximum in delivered power per unit length, by the electron beam, along a width of the target may represent e.g. a vapor generation from the target, and/or a maximum surface temperature of the target. The maximum in delivered power per unit length, by the electron beam, along a width of the target may be determined by determining the power density profile.

The power density profile may represent power density as a function of location within the electron beam. The power density profile may represent an absolute power as a function of absolute location within the electron beam. The power density profile is preferably determined such that it represents a power density at a location where the electron beam interacts with the target.

For the purpose of achieving the object of the inventive concept, it may not be necessary to determine the power density profile in two dimensions, but only one dimension. By determining the power density profile along a line being parallel to the width of the target, the object of the present inventive concept may be achieved.

The step of determining the power density profile of the electron beam may comprise: determining a scale factor of the X-ray source relating a deflection current to a displacement of the electron beam relative the target; measuring a quantity indicative of an interaction between the electron beam and the target for a range of displacements of the electron beam; and calculating the power density profile of the electron beam based on the quantity.

The step of determining the power density profile of the electron beam may comprise: determining a scale factor of the X-ray source relating a deflection current to a displacement of the electron beam relative the target; assuming a shape of the power density profile of the electron beam; measuring a quantity indicative of an interaction between the electron beam and the target for a range of displacements of the electron beam; and calculating the power density profile of the electron beam based on the quantity by adjusting the target width such that a shape of the calculated power density profile approaches the assumed shape.

The step of determining the power density profile of the electron beam may comprise: determining a scale factor of the X-ray source relating a deflection current to a displacement of the electron beam relative the target; measuring a quantity indicative of an interaction between the electron beam and the target for a range of displacements of the electron beam; and calculating the power density profile of the electron beam based on the measured quantity and the observation that the integral of the measured quantity over the entire range of displacements is independent of the electron beam width.

The step of determining the scale factor will now be discussed. The scale factor represents a displacement of the electron beam as a function of deflection current. The scale factor depends on both acceleration voltage and focus current of the electron beam. A higher focus current, i.e. more focusing of the electron beam, results in a smaller displacement of the electron beam for a given deflection current. A higher acceleration voltage, i.e. more energetic, faster electrons, also contribute to a smaller displacement of the electron beam for a given deflection current.

The step of determining the scale factor may comprise at least one of: receiving the scale factor from a scale factor database; displacing the electron beam on the target and measuring a movement of an X-ray spot generated on the target; and displacing the electron beam on a sensor aperture having predetermined aperture dimensions. It may be preferable to determine the scale factor by displacing the electron beam on the target, since it is the scale factor for displacement of the electron beam on the target that is of interest. If the scale factor is determined by e.g. displacing the electron beam on a sensor aperture arranged downstream of the target in a plane different to the target, the scale factor may be required to be transformed to a plane of the target. In general, a scale factor determined by observing displacement of the electron beam at a first location may not be equal to a scale factor determined by observing displacement of the electron beam at a second location, if the distances from the deflection means of the X-ray source to the first and second location, respectively, are different.

The scale factor database may comprise scale factor data pertaining to scale factors for a plurality of different focus currents and acceleration voltages of the X-ray source. Such scale factor data may be compiled during e.g. a factory set-up for the specific X-ray source. Such a database may also be continuously updated during use of the X-ray source.

The movement of the X-ray spot generated on the target may be measured using e.g. a pin-hole camera arranged to collect X-ray radiation from the X-ray source.

The scale factor may be obtained by measuring the deflection current needed to displace the electron beam over a sensor aperture having a predetermined aperture dimension.

The target width may not be explicitly needed when calculating the power density profile. From the quantity indicative of the interaction between the electron beam and the target one may obtain a measure on how many electrons are scattered from the target. This measure should be independent of electron beam width provided the total flux of electrons is preserved while the width is changed. Since no more than 100% of the incoming electrons can be scattered an estimate of target width may be obtained by calculating the width corresponding to the case when said measure would correspond to all electrons being scattered. Furthermore, this width may not be needed to complete the determination of the power density profile. That said measure is independent of electron beam width may mathematically be expressed as an integral that is invariant under changes of the electron beam width; this mathematical entity may be enough to calculate the power density profile. An embodiment where the explicit width may not be needed is where a shape of the power density profile is known or assumed known beforehand. An optimization algorithm may be employed that ensures that the calculated power density profile approximates the set shape and reproduces the measured quantity indicative of interaction between the electron beam and the target. The target width may be a free parameter during this optimization process; however, the target width may not be explicitly calculated.

The method may further comprise a step of determining a target width.

The step of determining the target width may comprise at least one of: receiving the target width from a target width database; and setting the width of the electron beam to a width smaller than an expected target width, measuring the quantity indicative of the interaction between the target and the electron beam for a range of displacements of the electron beam, and calculating the target width based on the measured quantity. Provided the electron beam width is smaller than the target width the measured quantity may go to, or approach, zero as the electron beam is displaced to or from a position where it is fully obscured by the target. By making the electron beam width even smaller a sharper transition may be obtained, thus a certainty of the determined target width may increase.

The target width database may comprise target width data pertaining to target widths. If the X-ray source utilizes a liquid target, the target width may be estimated based on a nozzle diameter of the X-ray source forming the liquid target. Such an estimation may be valid over a lifetime of the X-ray source provided wear of the nozzle is negligible. Further, such target width data may be compiled during e.g. a factory set-up of the specific X-ray source for the specific nozzle used in the X-ray source. Such target width data may also be continuously updated during use of the X-ray source.

Setting the width of the electron beam may be achieved via an arrangement comprising stigmator coils for adjusting a width and/or a height of the electron beam. The stigmator coils may provide a quadrupole electromagnetic field which will result in a reshaping of an electron beam cross-section. To a first approximation the stigmator coils may change electron beam width and electron beam height on the target in equal amounts with opposite signs. The stigmator coils in combination with the focusing coil may thus provide independent setting of electron beam width and height. As an example, a circular spot having a diameter of 50 μm may be reshaped to an elliptical spot with a width of 80 μm and a height of 20 μm. The available range of reshaping is limited by the field strength provided by the stigmator coils. To get larger range higher field strengths are required. This may be realized with larger coils and/or higher currents.

If a liquid target is used, the expected target width may be estimated by e.g. taking the nozzle diameter and/or the flow rate into account. If a solid target is used, the target width may be substantially constant over time, and the expected target width may thus be determined e.g. when installing the solid target in the X-ray source. A liquid jet target may due to its replenishing nature be advantageous over a stationary target. In the stationary target case, the thermal load may be limited by the thermal energy that is accumulated over time, whereas the thermal load in the liquid jet case instead may be limited by the maximum or peak of the power density profile.

The step of determining the scale factor may comprise displacing the electron beam on the target and measuring the quantity indicative of the interaction between the electron beam and the target, and calculating the scale factor based on the quantity and the target width.

The quantity indicative of an interaction between the electron beam and the target may pertain to at least one of: detecting backscattered electrons and/or emitted electrons formed by the interaction of the electron beam and the target; and detecting X-ray radiation generated by the interaction of the electron beam and the target.

Backscattered electrons may be detected by a back-scattering detector arranged in a position to receive and detect backscattered electrons. A back-scattering detector may be located relatively close to an optical axis of the electron beam if the geometry of the device so permits, or may be placed separated from the optical axis along a main path of backscattered electrons, as is the usual practice in a scanning-electron microscope.

Similarly, emitted electrons may be detected by an emitted electron detector arranged in a position to receive and detect emitted electrons. The backscattered electron detector and the emitted electron detector may be one and the same electron detector.

The X-ray source may comprise an electron detector arranged downstream of the target in a propagation direction of the electron beam, wherein the quantity indicative of an interaction between the electron beam and the target may pertain to: detecting electrons collected by the electron detector for the range of displacements of the electron beam.

The X-ray source may comprise an electron detector arranged downstream of the target in a propagation direction of the electron beam, wherein the electron detector comprises one or several segments, each segment being configured to detect electrons in an area corresponding to said segment, wherein the step of determining the power density profile of the electron beam may comprise: directing the electron beam to the electron detector; calculating the power density profile based on signals received from the segment (s). In case of a single segment, i.e., a one-dimensional sensor, the contrast in signal as the electron beam is scanned from a position beside the target, and into and over the target, may provide a power density profile in terms of power per unit length.

The step of setting the width and the total power of the electron beam such that the electron spot exceeds the X-ray spot in at least one direction may comprise: setting the width of the electron beam such that said width is larger than a width of the X-ray spot, wherein the width of the electron beam is substantially parallel to the target width.

The step of setting the width and the total power of the electron beam such that the electron spot exceeds the X-ray spot in at least one direction may comprise setting the width of the electron beam such that the width of the electron beam is greater than a height of the electron beam, wherein the height is substantially perpendicular to the width of the electron beam. The height of the electron beam may be set to be at least 4 times smaller than the width of the electron beam.

The target may be a liquid target. The target may be a liquid metal jet.

According to a second aspect, an X-ray source is provided. The X-ray source may comprise a target generator configured to provide a liquid jet forming a target, and an electron source configured to provide an electron beam forming an electron spot on the target and interacting with the target to generate X-ray radiation from an X-ray spot on the target. Further, the X-ray source may comprise a controller, at least one X-ray optical element or an X-ray optical system, having a field of view defining the X-ray spot, and an electron optic system interacting with the electron beam, wherein the controller is configured to operate the electron optic system and the electron source to determine a power density profile of the electron beam and to adjust a width and total power of the electron beam such that a maximum of the power density in the electron spot is below a predetermined limit, and such that a total power delivered to the target in the X-ray spot is increased.

It will be appreciated that a feature described in relation to a first aspect may also be incorporated in another aspect, and the advantage of the feature is applicable to all aspects in which it is incorporated.

According to an aspect of the inventive concept, a method for controlling an X-ray source is provided, the X-ray source being configured to emit, from an X-ray spot on a target, X-ray radiation generated by an interaction between an electron beam and the target, the method comprising providing the target having a target width; providing the electron beam arranged to form an electron spot on the target and to interact with the target to generate X-ray radiation in an interaction region; determining a power density profile of the electron beam; setting and/or adjusting the power density profile of the electron beam such that an amount of X-ray radiation generated is increased while limiting at least one of: a total vapor generation from the interaction between the electron beam and the target; a maximum of an applied power per unit area of the electron beam on the target surface; a target surface temperature; an applied power per unit length of the electron beam along the target width.

In a further aspect of the inventive concept, a method for controlling an X-ray source is provided, the X-ray source being configured to emit, from an X-ray spot on a target, X-ray radiation generated by an interaction between an electron beam and the target, the method comprising the steps of: providing the target having a target width; providing the electron beam arranged to form an electron spot on the target and to interact with the target to generate X-ray radiation in an interaction region; determining a power density profile of the electron beam; setting a width and a total power of the electron beam such that the electron spot exceeds the X-ray spot in at least one direction; and setting the total power of the electron beam such that a maximum of the power density in the electron spot is at a predetermined limit.

Setting a width of the electron beam such that the electron spot exceeds the X-ray spot in at least one direction may comprise setting a width of the electron beam such that the electron spot region is larger than the X-ray spot.

The 'predetermined limit' of the maximum of the power density may be based on, and/or directly proportional to a target surface temperature of the target. For example, the limit may be a maximum power capable of being delivered to the target without vaporizing the target. In another definition, the predetermined limit is a maximum of the power density that is possible to deliver to the electron spot while keeping a surface temperature of the target below a vaporizing temperature of the target material for a liquid target or below a melting point of the target material for a solid target.

The maximum of the power density delivered to the target is preferably set equal to or close to, but not above, the predetermined limit. The term 'close to' in this context may comprise a maximum of the power density being e.g. at least 75% of the predetermined limit, such as at least 90% of the predetermined limit, such as at least 95% of the predetermined limit, such as at least 99% of the predetermined limit.

Other objectives, features and advantages of the present inventive concept will appear from the following detailed disclosure, from the attached claims as well as from the drawings.

Generally, all terms used in the claims are to be interpreted according to their ordinary meaning in the technical field, unless explicitly defined otherwise herein. Further, the use of terms "first", "second", and "third", and the like, herein do not denote any order, quantity, or importance, but rather are used to distinguish one element from another. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated.

The inventive concept, and in particular the methods according to the inventive concept, may be embodied as computer-executable instructions distributed and used in the form of a computer program product including a computer-readable medium storing such instructions. By way of example, computer-readable media may comprise computer storage media and communication media. As is well known to a person skilled in the art, computer storage media includes both volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices. Further, it is known to the skilled person that communication media typically embodies computer readable instructions, data structures, program modules or other data in a modulated data signal such as a carrier wave or other transport mechanism and includes any information delivery media.

BRIEF DESCRIPTION OF THE DRAWINGS

The above, as well as additional objects, features and advantages of the present inventive concept, will be better understood through the following illustrative and non-limiting detailed description of different embodiments of the present inventive concept, with reference to the appended drawings, wherein.

DETAILED DESCRIPTION

An example of an X-ray source 100 which may utilize the method according to the inventive concept will now be described with reference to FIG. 1. The illustrated X-ray source 100 utilizes a liquid jet 110 as a target for the electron beam. However, as is readily appreciated by the person skilled in the art, other types of targets, such as solid targets, are equally possible within the scope of the inventive concept. Further, some of the disclosed features of the X-ray source 100 are merely included as examples, and may not be necessary for the operation of the X-ray source 100.

Figure 1:
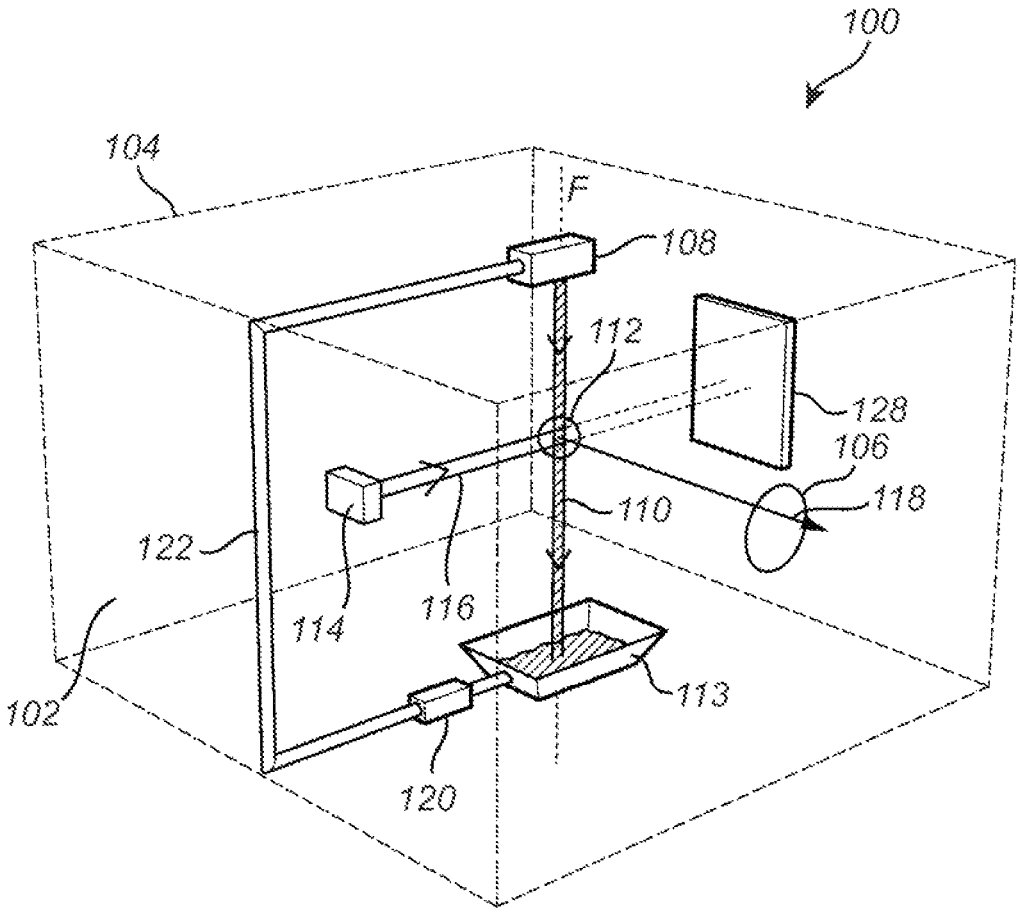
FIG. 1 schematically illustrates an example of an X-ray source which may utilize the method according to the inventive concept.

As indicated in FIG. 1, a low pressure chamber, or vacuum chamber, 102 may be defined by an enclosure 104 and an X-ray transparent window 106 which separates the low pressure chamber 102 from the ambient atmosphere. The X-ray source 100 comprises a liquid jet generator 108 configured to form a liquid jet 110 moving along a flow axis F. The liquid jet generator 110 may comprise a nozzle through which liquid, such as e.g. liquid metal may be ejected to form the liquid jet 110 propagating towards and through an intersecting region 112. The liquid jet 110 propagates through the intersecting region 112, towards a collecting arrangement 113 arranged below the liquid jet generator 108 with respect to the flow direction. The X-ray source 100 further comprises an electron source 114 configured to provide an electron beam 116 directed towards the intersecting region 112. The electron source 114 may comprise a cathode for the generation of the electron beam 116. In the intersecting region 112, the electron beam 116 interacts with the liquid jet 110 to generate X-ray radiation 118, which is transmitted out of the X-ray source 100 via the X-ray transparent window 106. The X-ray radiation 118 is here directed out of the X-ray source 100 substantially perpendicular to the direction of the electron beam 116.

The liquid forming the liquid jet is collected by the collecting arrangement 113, and is subsequently recirculated by a pump 120 via a recirculating path 122 to the liquid jet generator 108, where the liquid may be reused to continuously generate the liquid jet 110.

Still referring to FIG. 1, the X-ray source 100 here comprises an electron detector 128 configured to receive at least part of the electron beam 116 passing the liquid jet 110. The electron detector 128 is here arranged behind the intersecting region 112 as seen from a viewpoint of the electron source 114. It is to be understood that the shape of the electron detector 128 is here merely schematically illustrated, and that other shapes of the electron detector 128 may be possible within the scope of the inventive concept.

Figures 2A, 2B:
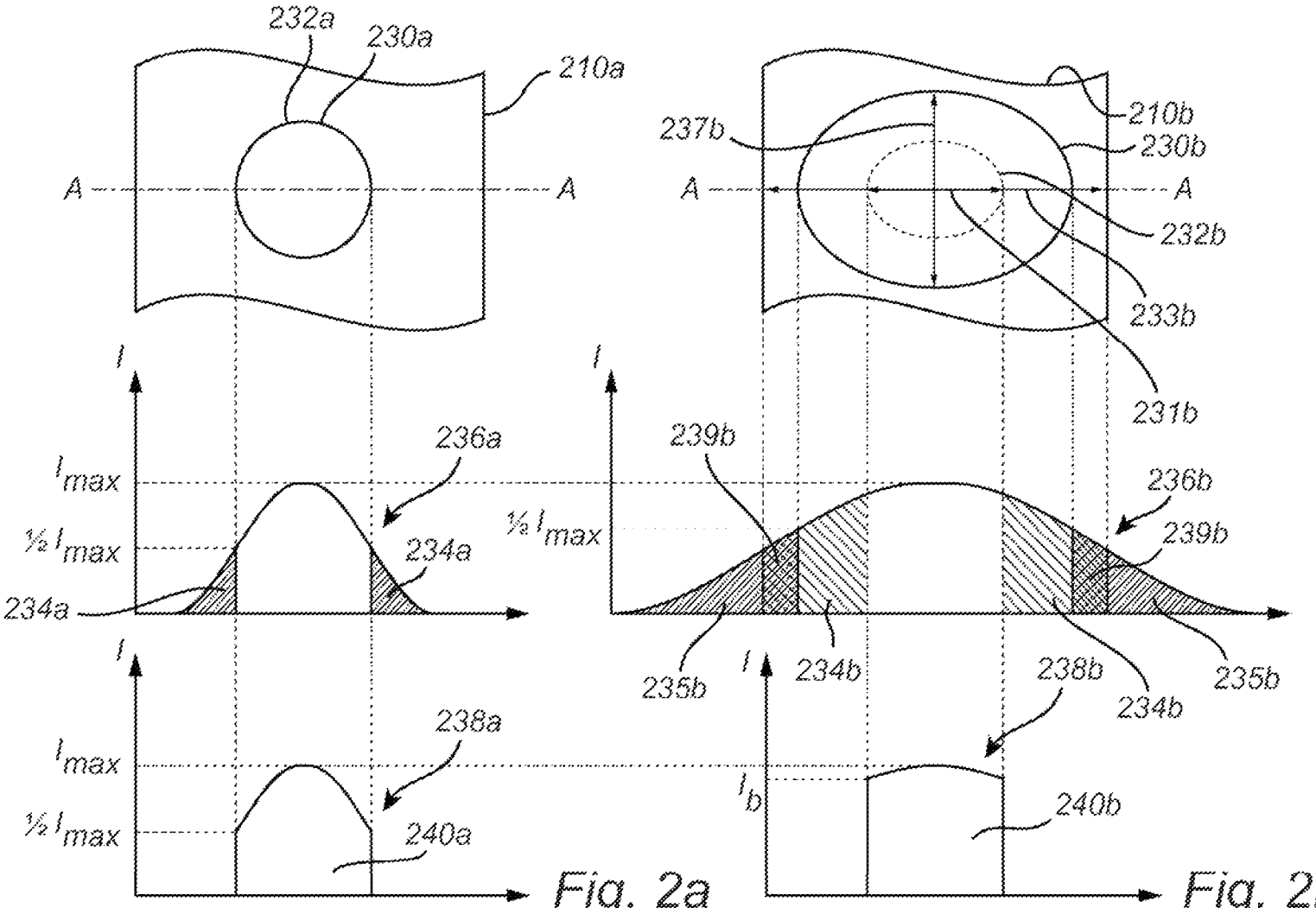
FIGS. 2*a* and 2*b* illustrate power densities and various regions on a target.

Referring now to FIG. 2*a*, a power density distribution and various regions on a target are illustrated. It should be noted these figures are not necessarily drawn to scale, and that the shapes of the illustrated features are not limiting but merely an example of possible shapes.

Part of a target 210*a* is shown, wherein an electron spot 230*a* and an X-ray spot 232*a* are illustrated. It may be noted that the electron spot 230*a* and the X-ray spot 232*a* in this particular example are overlapping. The graphs below the target 210*a* illustrate properties of the power density distribution along the line A-A indicated on the target 210*a*.

Below the target 210*a* in FIG. 2*a*, a graph illustrating the power density profile 236*a* of an electron beam is shown. As defined in the present disclosure, the electron spot 230*a* corresponds to the full width at half maximum $I_{max}$. Also, as illustrated by the shaded area 234*a*, some electrons do not contribute to the generation of X-ray radiation and may in some respects be deemed wasted. The area 234*a* under the graph 236*a* reflect the power of electrons that do not contribute to the generation of X-ray radiation.

At the bottom of FIG. 2*a*, a graph illustrating the power density distribution of electrons interacting with the target 210*a* within the X-ray spot 232*a* is shown. Since the amount of useful X-ray radiation generated in the target 210*a* may be proportional to the electron beam current striking the target within the X-ray spot 232*a*, the area 240*a* below the graph 238*a* may reflect the amount of useful X-ray radiation generated in the X-ray spot 232*a*. It may be noted that at the edge of the X-ray spot 232*a*, the power density $I_a$ is equal to half of $I_{max}$.

Referring now to FIG. 2*b*, a power density profile and various regions on a target are illustrated. It should be noted these figures are not necessarily drawn to scale, and that the shapes of the illustrated features are not limiting but merely an example of possible shapes.

Part of a target 210*b* is shown, wherein an electron spot 230*b* and an X-ray spot 232*b* are illustrated. It may be noted that the electron spot 230*b* exceeds the X-ray spot 232*b*. In particular, a width 233*b* of the electron spot 230*b* is larger than a width 231*b* of the X-ray spot 232*b*. Further, the electron spot 230*b* here has a width 233*b* being larger than a height 237*b* of the electron spot 230*b*. The graphs below the target 210*b* illustrate properties of the power density profile along the line A-A indicated on the target 210*b*.

Below the target 210*b* in FIG. 2*b*, a graph illustrating the power density profile 236*b* of an electron beam is shown. As defined in the present disclosure, the electron spot 230*b* corresponds to the full width at half maximum $I_{max}$. It is emphasized that a total power of the electron beam pertaining to the power density profile 236*b* is higher compared to a total power of the electron beam pertaining to the power density profile 236*a* illustrated in FIG. 2*a*. The higher total power may be achieved by e.g. increasing a current applied to the electron source.

Also, as illustrated by the shaded area 234*b*, some electrons do contribute to the generation of X-ray radiation, but do not generate X-ray radiation in the X-ray spot 232*b* and may in some respects be deemed wasted. In particular, the area 234*b* reflects the power of electrons interacting with the target 210*b* to generate X-ray radiation outside of the X-ray spot 232*b*. Such X-ray radiation is not emitted by the X-ray source to be utilized in applications such as e.g. imaging or diffraction applications.

The area 239*b* reflects the power of electrons that do not contribute to the generation of X-ray radiation. Further, the area 235*b* reflect the power of electrons that do not interact with the target 210*b*, but instead pass on e.g. the sides of the target 210*b*. In other words, the area 235*b* reflects the power of electrons that do not interact with the target 210*b* to generate X-ray radiation. The sum of the areas 234*b*, 235*b*, and 239*b* reflect the power of electrons that do not contribute to generating X-ray radiation in the X-ray spot 232*b*.

It may be noted that the sum of the areas 234*b*, 235*b*, and 239*b* is larger than the area 234*a* of FIG. 2*a*. In other words, by setting the width of the electron beam such that the electron spot 230*b* exceeds the X-ray spot 232*b*, more power may be deemed wasted in the sense that the power of electrons that do not contribute to generating X-ray radiation in the X-ray spot 232*b* is increased.

At the bottom of FIG. 2*b*, a graph illustrating the power density distribution of electrons interacting with the target 210*b* within the X-ray spot 232*b* is shown. Since the amount of useful X-ray radiation generated in the target 210*b* may be proportional to the electron beam current striking the target within the X-ray spot 232*b*, the area 240*b* below the graph 238*b* may reflect the amount of useful X-ray radiation generated in the X-ray spot 232*b*. It may be noted that at the edge of the X-ray spot 232*b*, the power density $I_b$ is greater than half of $I_{max}$. In particular, it may be noted that the area 240*b*, which reflects the amount of useful X-ray radiation generated in the X-ray spot 232*b*, is larger than the area 240*a* of FIG. 2*a*, which reflects the amount of useful X-ray radiation generated in the X-ray spot 232*a*. Hence, by setting the width of the electron beam such that the electron spot 230*b* exceeds the X-ray spot 232*b*, more useful X-ray radiation may be generated in the X-ray spot 232*b*, compared to setting the width of the electron beam such that the electron spot is equal to or smaller than the X-ray spot.

The maximum power density $I_{max}$ of FIGS. 2*a* and 2*b* may represent the predetermined limit of the power density. In other words, the maximum power density $I_{max}$ may correspond to a power density level which is below a level causing the target to vaporize in case of a liquid anode or melt in case of a solid anode. The maximum power density $I_{max}$ may also correspond to a level which causes the target to assume a surface temperature below a vaporizing temperature of the target material in case of a liquid target or a below a melting point of the target material in case of a solid target. In case the maximum power density $I_{max}$ of the power density profile is not at the predetermined limit, the power of the electron beam may be adjusted, i.e. increased or decrease, in order to set the maximum power density at the predetermined limit.

Figure 2C:
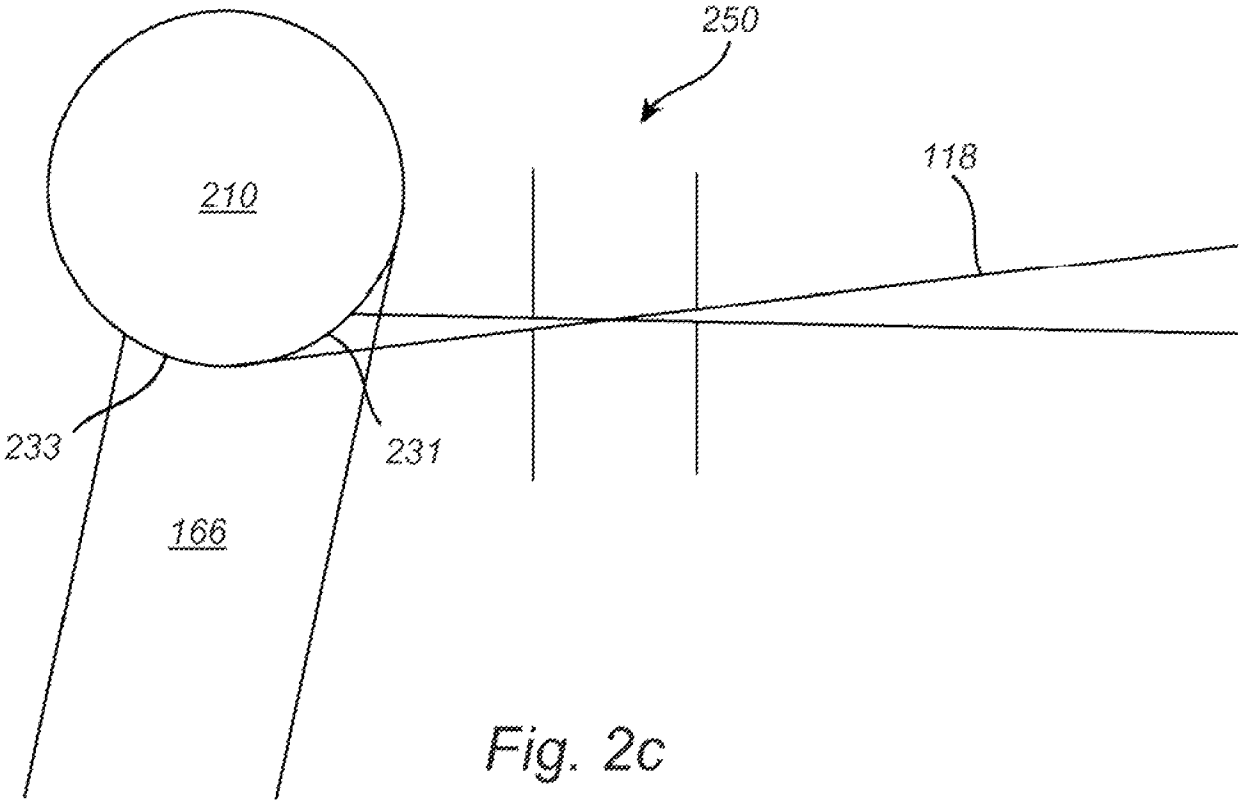
FIG. 2*c* illustrates a cross section of a target according to the inventive concept.

FIG. 2*c* is a cross section of a liquid target 210, orthogonal to a propagation direction of the target material. The width of the electron spot 233 is in this example defined by the width of the electron beam 166 impinging on the target, whereas the width of the X-ray spot 231 is defined by the relative orientation of the target and an X-ray optical component, in this example illustrated by two apertures 250 forming a pinhole configuration; other components and X-ray optical systems, for example comprising focusing mirrors, are however also conceivable. In the present example, the size of the X-ray spot is defined by the direction in which the X-ray radiation 118 is emitted, and thus the geometry of the target, and by the field of view defined by the apertures 250 used for collecting the generated X-ray radiation 118. X-ray radiation 118 lying outside the field of view may not be considered to origin from the X-ray spot, according to the definition used in the context of the present disclosure. It will be appreciated that the electron spot 233 may be defined by the width of the electron beam 166 and/or the size and orientation of the target 210. In case the electron beam 166 is wider than the target 210, the electron spot 233 may have a width corresponding to the width of the target 210. In case the electron beam 166 is narrower than the target 210, as shown in the present example, the electron spot 233 size may be determined by the width of the electron beam 166, such as its full width at half maximum (FWHM).

Figure 3:
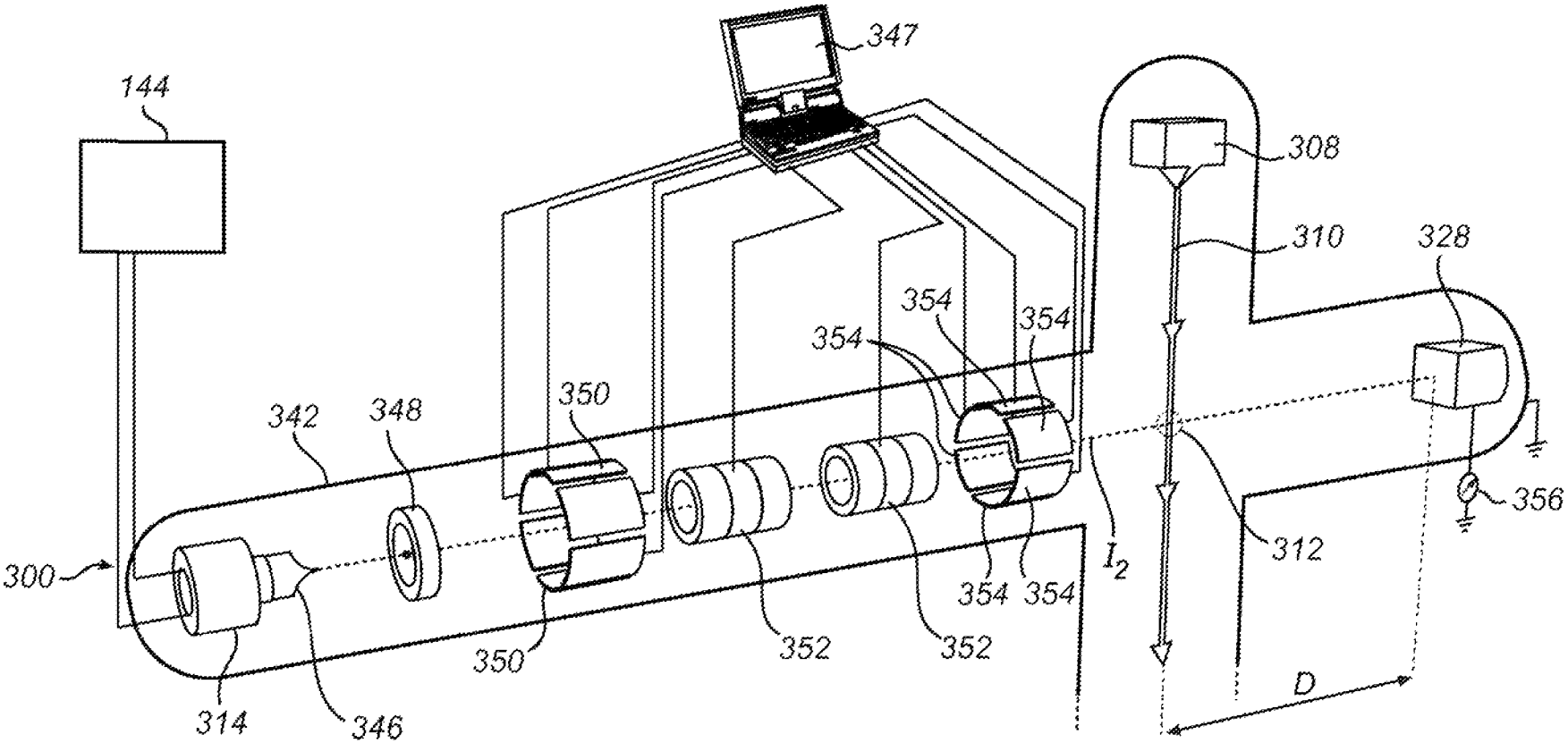
FIG. 3 schematically illustrates an example of an X-ray source which may utilize the method according to the inventive concept.

With reference to FIG. 3, an example of an X-ray source 300 which may utilize the method according to the inventive concept will now be described. The illustrated X-ray source 300 utilizes a liquid jet 310 as a target for the electron beam. However, as is readily appreciated by the person skilled in the art, other types of targets, such as solid targets, are equally possible within the scope of the inventive concept. Further, some of the disclosed features of the X-ray source 300 are merely included as examples, and may not be necessary for the operation of the X-ray source 300.

The X-ray source 300 generally comprises an electron source 314, 346, and a liquid jet generator 308 configured to form a liquid jet 310 acting as an electron target. The components of the X-ray source 300 is located in a gas-tight housing 342, with possible exceptions for a power supply 144 and a controller 347, which may be located outside the housing 342 as shown in the drawing. Various electron-optical components functioning by electromagnetic interaction may also be located outside the housing 342 if the latter does not screen off electromagnetic fields to any significant extent. Accordingly, such electron-optical components may be located outside the vacuum region if the housing 342 is made of a material with low magnetic permeability, e.g., austenitic stainless steel. The electron source generally comprises a cathode 314 which is powered by the power supply 144 an includes an electron emitter 346, e.g. a thermionic, thermal-field or cold-field charged-particle source. Typically, the electron energy may range from about 5 keV to about 500 keV. An electron beam from the electron source is accelerated towards an accelerating aperture 348, at which point it enters an electron-optical system comprising an arrangement of aligning plates 350, lenses 352 and an arrangement of deflection plates 354. Variable properties of the aligning plates 350, lenses 352, and deflection plates 354 are controllable by signals provided by the controller 347. In the illustrated example, the deflection and alignment plates 350, 354 are operable to accelerate the electron beam in at least two transversal directions. After initial calibration, the aligning plates 350 are typically maintained at a constant setting throughout a work cycle of the X-ray source 300, while the deflection plates 354 are used for dynamically scanning or adjusting an electron spot location during use of the X-ray source 300. Controllable properties of the lenses 352 include their respective focusing powers (focal lengths). Although the drawing symbolically depicts the aligning, focusing and deflecting means in a way to suggest that they are of the electrostatic type, the invention may equally well be embodied by using electromagnetic equipment or a mixture of electrostatic and electromagnetic electron-optical components. The X-ray source may comprise stigmator coils 353 which may provide for that a non-circular shape of the electron spot may be achieved.

Downstream of the electron-optical system, an outgoing electron beam 12 intersects with the liquid jet 310 in an intersecting region 312. This is where the X-ray production may take place. X-ray radiation may be led out from the housing 342 in a direction not coinciding with the electron beam. Any portion of the electron beam 12 that continues past the intersecting region 312 may reach an electron detector 328. In the illustrated example, the electron detector 328 is simply a conductive plate connected to earth via an ammeter 356, which provides an approximate measure of the total current carried by the electron beam $I_2$ downstream of the intersecting region 312. As the figure shows, the electron detector 328 is located a distance D away from the intersecting region 312, and so does not interfere with the regular operation of the X-ray source 300. Between the electron detector 328 and the housing 342, there is electrical insulation, such that a difference in electrical potential between the electron detector 328 and the housing 342 can be allowed. Although the electron detector 328 is shown to project out from the inner wall of the housing 342, it should be understood that the electron detector 328 could also be mounted flush with the housing wall. The electron detector may further be equipped with an aperture arranged so that electron impinging inside the aperture may be registered by the electron detector whereas electrons impinging outside of the aperture may not be detected.

A lower portion of the housing 342, a vacuum pump or similar means for evacuating gas molecules from the housing 342, receptacles and pumps for collecting and recirculating the liquid jet are not shown on this drawing. It is also understood that the controller 347 has access to the actual signal from the ammeter 356.

Figure 4:
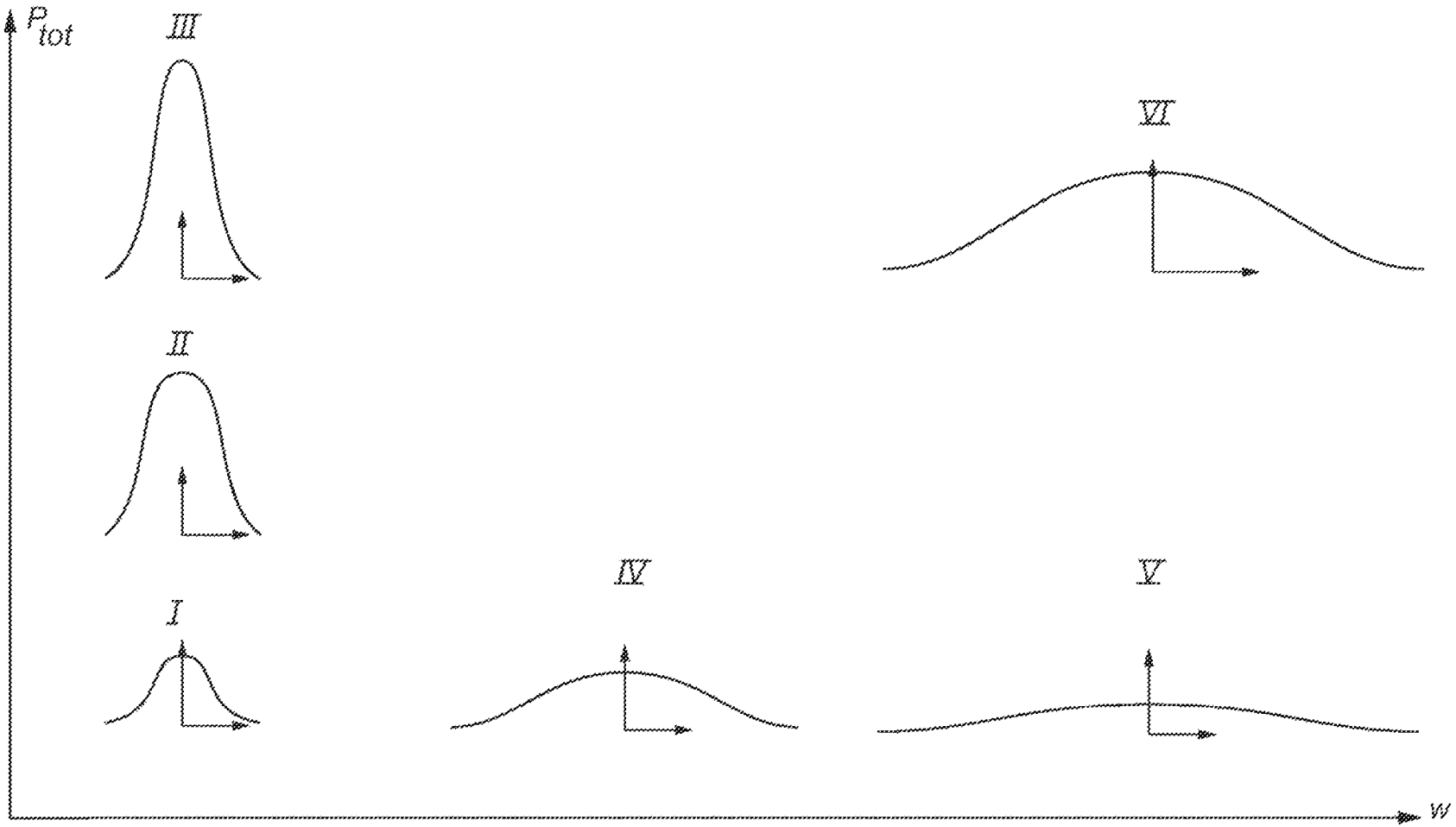
FIG. 4 schematically illustrates various power density profiles and how they are affected by electron beam width and total power.

Referring now to FIG. 4, various power density profiles of an electron beam are shown, and the effect of adjusting width and/or total power of the electron beam is schematically illustrated.

In each power density profile I-VI, the vertical axis represents power per unit length, while the horizontal axis represents position along an arbitrary line of the electron beam.

The power density profiles I-VI are arranged in a relative coordinate system, wherein positive or negative movement along the horizontal axis corresponds to an increase or decrease in electron beam width respectively, and wherein a positive or negative movement along the vertical axis corresponds to an increase or decrease in total power of the electron beam respectively.

Power density profiles I, II and III represent electron beams having equal electron beam width. However, the total power of each of the electron beams associated with each of the power density profiles I, II and III is increased through I to II to III. Accordingly, a maximum power density, and/or a maximum in delivered power per unit length, is increased moving from power density profile I to III along the vertical axis of the drawing.

Power density profiles I, IV and V represent electron beams having equal total power. However, the width of each of the electron beams associated with each of the power density profiles I, IV and V is increased through I to IV to V. Accordingly, a maximum power density, and/or a maximum in delivered power per unit length, is decreased through power density profile I to V along the horizontal axis of the drawing. Further, the spot size, i.e. the full width at half maximum of the power density profile, is increased through power density profile I to V along the horizontal axis of the drawing.

Power density profile VI represent an electron beam having an increased width and total power compared to the electron beam associated with power density profile I. As can be seen, the maximum power density of power density profile VI, and/or the maximum in delivered power per unit length of power density profile VI, is unchanged compared to power density profile I. However, the width of power density profile VI is increased.

Figure 5:
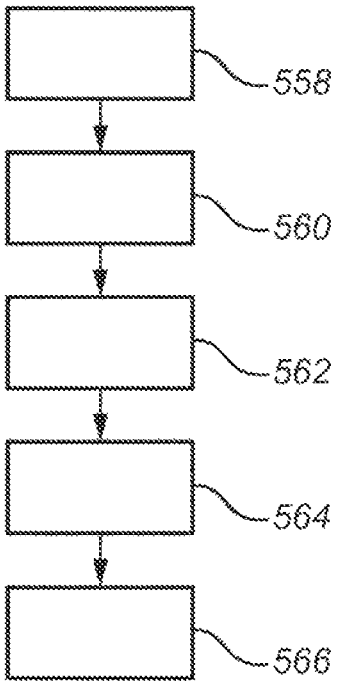
FIG. 5 illustrates a method for controlling an X-ray source in a block diagram. The figures are not necessarily to scale, and generally only show parts that are necessary in order to elucidate the inventive concept, wherein other parts may be omitted or merely suggested.

A method for controlling an X-ray source according to the inventive concept will now be described with reference to FIG. 5. For clarity and simplicity, the method will be described in terms of 'steps'. It is emphasized that steps are not necessarily processes that are delimited in time or separate from each other, and more than one 'step' may be performed at the same time in a parallel fashion.

The method for controlling an X-ray source configured to emit, from a X-ray spot on a target, X-ray radiation generated by an interaction between an electron beam and the target, comprises the step 558 of providing the target; the step 560 of providing the electron beam arranged to interact with the target to generate X-ray radiation in an interaction region; the step 562 of determining a power density profile of the electron beam; the step 564 of setting a width and a total power of the electron beam such that the electron spot exceeds the X-ray spot in at least one direction; and the step 566 of setting the total power of the electron beam such that a maximum power density in the target is at a predetermined limit.

The person skilled in the art by no means is limited to the example embodiments described above. On the contrary, many modifications and variations are possible within the scope of the appended claims. In particular, X-ray sources and systems comprising more than one target or more than one electron beam are conceivable within the scope of the present inventive concept. Furthermore, X-ray sources of the type described herein may advantageously be combined with X-ray optics and/or detectors tailored to specific applications exemplified by but not limited to medical diagnosis, non-destructive testing, lithography, crystal analysis, microscopy, materials science, microscopy surface physics, protein structure determination by X-ray diffraction, X-ray photo spectroscopy (XPS), critical dimension small angle X-ray scattering (CD-SAXS), and X-ray fluorescence (XRF). Additionally, variation to the disclosed examples can be understood and effected by the skilled person in practicing the claimed invention, from a study of the drawings, the disclosure, and the appended claims. The mere fact that certain measures are recited in mutually different dependent claims does not indicate that a combination of these measures cannot be used to advantage.

LIST OF REFERENCE SIGNS

100 X-ray source
102 Vacuum chamber
104 Enclosure

106 X-ray transparent window
108 Liquid jet generator
110 Liquid jet
112 Intersecting region
113 Collecting arrangement
114 Electron source
116 Electron beam
118 X-ray radiation
120 Pump
122 Recirculating path
128 Electron detector
144 Power Supply
210*a,b* Target
230*a,b* Electron spot
231*b* Width of X-ray spot
232*a,b* X-ray spot
233*b* Width of electron spot
234*a,b* Area
235*b* Area
236*a,b* Power density profile
237*b* Height of electron spot
238*a,b* Power density profile
239*b* Area
240*a,b* Area
250 X-ray optical system
300 X-ray source
308 Liquid jet generator
310 Liquid target
312 Intersecting region
314 Cathode
328 Electron detector
342 Housing
346 Electron emitter
347 Controller
350 Aligning plates
352 Lenses
353 Stigmator coils
354 Deflection plates
356 Ammeter
558 Step of providing the target
560 Step of providing the electron beam
562 Step of determining a power density profile
564 Step of setting a width and a total power of the electron beam
566 Step of setting the total power of the electron beam
I Power density profile
II Power density profile
III Power density profile
IV Power density profile
V Power density profile
VI Power density profile
F Flow axis
D Distance
$I_2$ Electron beam

The invention claimed is:

1. A method for controlling an X-ray source configured to emit, from an X-ray spot on a target, X-ray radiation generated by an interaction between an electron beam and the target, wherein the X-ray spot is determined by the field of view of an X-ray optical system of the X-ray source, the method comprising the steps of:

providing a liquid jet forming the target;

providing the electron beam accelerated by an acceleration voltage, forming an electron spot focused on the target by means of a focus current, and arranged to interact with the target to generate X-ray radiation;

determining a scale factor for the acceleration voltage and the focus current relating a deflection current to a displacement of the electron beam relative to the target;

measuring a quantity indicative of an interaction between the electron beam and the target for a range of displacements of the electron beam;

calculating a power density profile of the electron beam based on the quantity;

adjusting a width and a total power of the electron beam such that a maximum of the power density profile thereby obtained in the electron spot is below a predetermined limit, and such that a total power delivered to the target in the X-ray spot is increased.

2. The method according to claim 1, wherein the width and total power of the electron beam is further adjusted such that an X-ray source performance indicator is below a predetermined threshold.

3. The method according to claim 2, wherein the X-ray source performance indicator is associated with at least one of:

a total vapor generation from the target;

a maximum in delivered power per unit area to the target by the electron beam;

a maximum surface temperature of the target; and a maximum in delivered power per unit length, by the electron beam, along a width of the target.

4. The method according to claim 1, wherein the step of determining the scale factor comprises at least one of:

receiving the scale factor from a scale factor database;

displacing the electron beam on the target and measuring a movement of an X-ray spot generated on the target; and displacing the electron beam on a sensor aperture having predetermined aperture dimensions.

5. The method according to claim 1, further comprising determining a target width.

6. The method according to claim 5, wherein the step of determining the target width comprises at least one of:

receiving the target width from a target width database; and setting the width of the electron beam to a width smaller than an expected target width, measuring the quantity indicative of the interaction between the target and the electron beam for a range of displacements of the electron beam, and calculating the target width based on the measured quantity.

7. The method according to claim 5, wherein the step of determining the scale factor comprises displacing the electron beam on the target and measuring the quantity indicative of the interaction between the electron beam and the target, and calculating the scale factor based on the quantity and the target width.

8. The method according to claim 1, wherein the quantity indicative of an interaction between the electron beam and the target pertains to detecting backscattered electrons and/or emitted electrons formed by the interaction of the electron beam and the target.

9. The method according to claim 1, wherein the quantity indicative of an interaction between the electron beam and the target pertains to detecting X-ray radiation generated by the interaction of the electron beam and the target.

10. The method according to claim 1, wherein the X-ray source comprises an electron detector arranged downstream of the target in a propagation direction of the electron beam, wherein the quantity indicative of an interaction between the electron beam and the target pertains to:

detecting electrons collected by the electron detector for the range of displacements of the electron beam.

11. An X-ray source comprising:

a target generator configured to provide a liquid jet forming a target;

an electron source configured to provide an electron beam forming an electron spot on the target and interacting with the target to generate X-ray radiation from an X-ray spot on the target;

an acceleration aperture arranged for providing an acceleration voltage for accelerating the electron beam;

a focusing coil arranged for focusing the electron beam by application of a focus current;

a controller;

an X-ray optical system having a field of view defining the X-ray spot; and an electron optical system interacting with the electron beam;

wherein the controller is configured to determine a scale factor for the acceleration voltage and the focus current relating a deflection current to a displacement of the electron beam relative to the target and further to operate the electron optic system and the electron source to determine a power density profile of the electron beam, and to adjust a width and total power of the electron beam such that a maximum of the power density profile thereby obtained in the electron spot is below a predetermined limit, and such that a total power delivered to the target in the X-ray spot is increased.

* * * * *